US006090158A

United States Patent [19]

McLaughlin

[11] Patent Number: 6,090,158

[45] Date of Patent: Jul. 18, 2000

[54] LOCALIZED FINISHING OF GARMENT WORKPIECES

[75] Inventor: Richard S. McLaughlin, Tool, Tex.

[73] Assignee: Levi Strauss & Co., Del.

[21] Appl. No.: 09/149,755

[22] Filed: Sep. 8, 1998

[51] Int. Cl.[7] ..... D06P 5/02

[52] U.S. Cl. ..... 8/400; 8/444; 8/115.52; 223/1; 26/70; 26/28; 356/402; 250/226

[58] Field of Search ..... 118/712, 713, 118/324; 8/400, 444, 115.52; 223/1; 26/70, 28, 27; 356/402; 250/226

[56] References Cited

U.S. PATENT DOCUMENTS

| | | | |
|---|---|---|---|
| 5,213,581 | 5/1993 | Olson et al. | 8/401 |
| 5,567,207 | 10/1996 | Lockman et al. | 8/444 |
| 5,593,072 | 1/1997 | Hester et al. | 223/120 |
| 5,633,722 | 5/1997 | Wasinger et al. | 356/402 |
| 5,790,687 | 8/1998 | McLaughlin et al. | 382/111 |

FOREIGN PATENT DOCUMENTS

WO 97/16279 5/1997 WIPO .

*Primary Examiner*—Laura Edwards

*Attorney, Agent, or Firm*—Medlen & Carroll, LLP

[57] ABSTRACT

A method and system is disclosed for producing localized abraded, faded and worn finishing effects on a garment by applying a finishing pattern to its component pre-cut, individual fabric workpieces before assembly by sewing. An optical detection system that contains at least one video camera operatively connected to a controller is used to capture an electronic image of a fabric workpiece which is compared to a set of stored known images contained in memory accessible by the controller. Once the workpiece is identified, the controller locates in memory a finishing pattern to be applied to the workpiece. The workpiece can be secured if necessary to a work surface, and a mechanical or electronic device used to duplicate the abraded, faded and worn pattern on the workpiece. After the finishing pattern has been applied, the workpiece can be released and moved downstream for further processing and sewing into a completed garment.

20 Claims, 6 Drawing Sheets

LOCALIZED FINISHING OF GARMENT WORKPIECES

FIELD OF THE INVENTION

The present invention relates generally to finishing textile materials. More particularly, the present invention relates to garments having localized finishing effects which simulate natural wear.

BACKGROUND OF THE INVENTION

A garment is conventionally produced using an actual or virtual pattern which is used to cut the several fabric workpieces which are conventionally sewn together in a predetermined manner to produce the completed garment. For example, a typical pair of trousers is formed from a right front leg panel, and left front leg panel, a right rear panel and left rear panel, a back panel, a waistband, and one or more pockets. Each of these workpieces has a very different and distinctive shape from the other workpieces used to create a specific garment. Moreover, the dimensions of any specific shaped workpiece will typically be different from one sized garment to another. Automatic cutting machines can be used to mass-produce stacks of workpieces of identical size and shape which can be used in the mass-production of garments. A workpiece or bundle of like workpieces are typically marked with a code or other marking which provides information to the operator regarding the size of the completed garment.

Fashion trends impact how clothes are designed and manufactured. The popularity of denim garments having a faded and worn appearance have caused manufacturers of denim garments to process their fabric in such a ways as to reproduce this look. Initially, denim is a stiff and durable cotton fabric. Sizing, which is added to denim to aid manufacturability, contributes to its stiffness. When denim is worn, the fabric becomes softer and the color fades. Laundering, which washes sizing and dye from the fabric, also softens and fades denim garments.

Various techniques have been used to reproduce the fading and softening that result from normal wear and aging. One conventional technique is stone washing. Stone washing involves mechanically abrading the fabric typically by laundering the denim garments with pumice stones, or the like, in a washing machine. The mechanical contact of the denim with the pumice stones abrades and softens the denim fabric and lightens its color.

Chemical finishing is another technique used to treat fabrics. The garments are mixed in solutions of various chemicals, such as bleaches and enzymes. These chemicals fade the fabric and can also soften it. Chemical finishing usually seeks to simulate the appearance of a "stone washed" fabric. One such chemical patent is U.S. Pat. No. 5,213,581 issued May 25, 1993 to OLSON et al., which discloses an immersion method for fading garments by washing the fabric with cellulase enzyme dissolved in an aqueous bath. The cellulase enzyme bath creates a stone-washed appearance in the fabric.

Because both stone washing and chemical treatment involve agitating the fabric in a tub, the fabric must be treated in its entirety. Treating the fabric as a whole creates two side effects. First, the fabric is typically finished as completed or substantially completed garments. If the fabric was stone washed or chemically treated earlier in the manufacturing process, it would remove the sizing prematurely, making sewing and handling of the fabric more difficult. The patent by OLSON et al. teaches chemical processing of unsewn fabric, but as stated above, finishing the entire fabric before assembling it into garments defeats the purpose of adding sizing.

The second side effect to these finishing techniques is that the fabric is uniformly faded, which is quite different from the localized wear which occurs over time when jeans are worn, and which provides more wear (and more fading) in areas of high wear, with less wear and fading in other areas. Because the garment in conventional finishing is washed as a whole, no part of the garment can receive more or less treatment. To obtain a more natural, localized effect, other mechanical abrasion techniques have been conceived. For example, U.S. Pat. No. 5,593,072 issued Jun. 14, 1997 to HESTER et al., incorporated herein by reference, discloses an automated system for localized finishing of completed garments. A computer and robot performs the finishing process once the completed garment is fitted onto an apparatus that orients the workpiece. Localized abrasion can be carried out by sand blasters, high pressure water, brushes, applicators which spray bleach or enzyme solution, and sand wheels. Although the HESTER patent can achieve localized fading, it requires specialized machinery. Additionally, it requires that the garments be sewn. Abrading sewn garments is problematic because it can weaken important threads that secure the garment pieces together.

A third class of fabric finishing is laser treating. For example, U.S. Pat. No. 5,567,207 issued Oct. 22, 1996 to LOCKMAN et al. discloses an apparatus and method for using lasers to cause photo-decomposition of the coloring agent in a fabric or garment while leaving the underlying textile material undamaged. Although LOCKMAN et al. discloses using a laser to fade dye prior to the fabric being cut and sewn into individual garments, it does not disclose how it can do so in a way which will produce natural looking, localized fading in a completed fabric. In addition, while lasers can be used to fade the dye in denim, the softening that mechanical and chemical abrading produce will apparently not occur following the teachings of LOCKMAN since the textile material is unaffected.

What is needed is an apparatus and method that can be used to produce natural localized fading and abrasion on cut workpieces prior to their being sewn together.

SUMMARY OF THE INVENTION

The present invention provides a process for producing garments having more natural, localized fading by using workpieces which have been finished before sewing. This process can be carried out using automatic means by which pre-cut fabric workpieces may be exposed to abrasion and fading across a predetermined area which is smaller than the workpiece itself. The apparatus and method of the present invention are particularly adapted to fade denim fabric. The term "fading" is meant to incorporate various means utilized to finish denim in such a way as to fade, abrade, and/or soften the fabric. Examples of fading techniques include contacting the fabric with mechanical abrasives, chemicals, and amplified light.

The method and apparatus disclosed produces natural, localized fading on preselected areas of garment workpieces prior to sewing. This approach has several benefits. First, since only a portion of the workpiece is treated, a substantial amount of the sizing still remains. Thus, the purpose of adding sizing, to aid manufacturability, is not frustrated. Second, the resulting garment is superior in quality to one that has been finished after being sewn together. Since the workpiece is abraded prior to being sewn together, key threads are not weakened. Third, a method that fades individual cut pieces is more repeatable and reproducible. This uniformity increase overall quality of the garments. Fourth, by only treating a localized amount, the process reduces the environmental impact. Less finishing materials are needed to treat a localized section than are needed to treat the entire garment. Finally, because less materials and energy are used to produce the final garment, the overall costs are reduced.

One objective of the present invention is to provide an apparatus and method that can produce localized fading (including abrading) in a pre-cut fabric workpiece. It is a further objective of the present invention to provide an automated means for achieving the localized fading so that the effect is reproducible and repeatable in every other similar workpieces.

The present invention comprises placing a pre-cut workpiece onto a work station. The work station is equipped with a visual detection system that can electronically image the workpiece. The visual detection system determines the location, orientation, and size of the workpiece. This information is then communicated to a controller. In the preferred embodiment, the controller compares the electronic image of the workpiece to a set of standard workpiece shapes. Each standard workpiece shape can be pre-assigned a finishing pattern or patterns. Once the controller identifies the workpiece's 12 pre-assigned pattern, the controller can use the workpiece size information to calculate a properly proportionate area to be finished.

Once the pattern and size of the finish have been determined, a finishing technique is applied. In the preferred embodiment the controller can manipulate one or more mechanical finishing devices. The choice of finishing device may be selected manually or may be done automatically by the controller. Ideally, the controller will automatically select a finishing device as part of the pre-assigned pattern.

A hold-down apparatus is additionally provided as a means for securing the workpiece to the work station for those finishing techniques that require the robot to contact the workpiece directly. The hold-down apparatus could comprise a vacuum generator that is connected to the work station. The top surface of the work station, the surface upon which the workpiece rests, can be provided with a plurality of small openings in communication with a vacuum plenum. Alternatively, mechanical hold down means such as movable fingers can be operatively linked to the controller for moving the hold-down apparatus onto the workpiece in such a way that it does not interfere with the finishing process. The hold-down apparatus could also comprise a substantially planar template with an opening that expose the area of the workpiece that is to be finished. The force of the template on the workpiece secures the workpiece to the work station.

Once the work piece is secured, the controller can direct and complete the finishing process. Following the completion of the finishing process, the workpiece is removed from the work station. The workpiece is then moved to then next station in the manufacturing process, where the finished workpiece can be sewn together with other workpieces in a complete garment.

DETAILED DESCRIPTION OF THE PREFERRED EMBODIMENT

Figure 1:
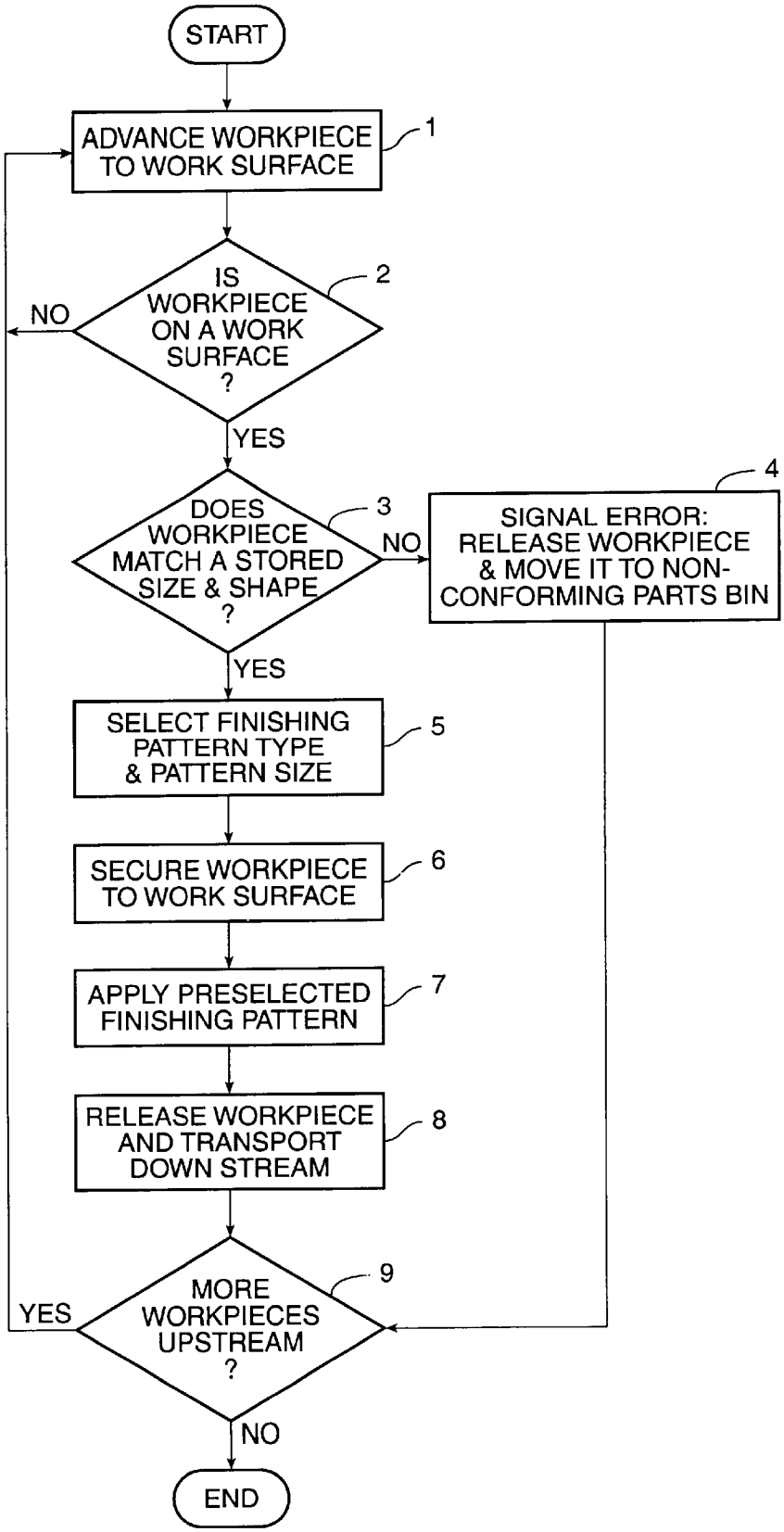
FIG. 1 is a flow chart depicting a method of the present invention.

FIG. 1 depicts in flow-chart form a method of the present invention to finish individual, pre-cut fabric workpieces. The following description is in terms of the preferred embodiment of the present invention. One skilled in the art will recognize that the steps outlined below can be modified in their sequencing, their content, and their application.

STEP 1: Advance a Workpiece to the Work Surface

Figure 2A:
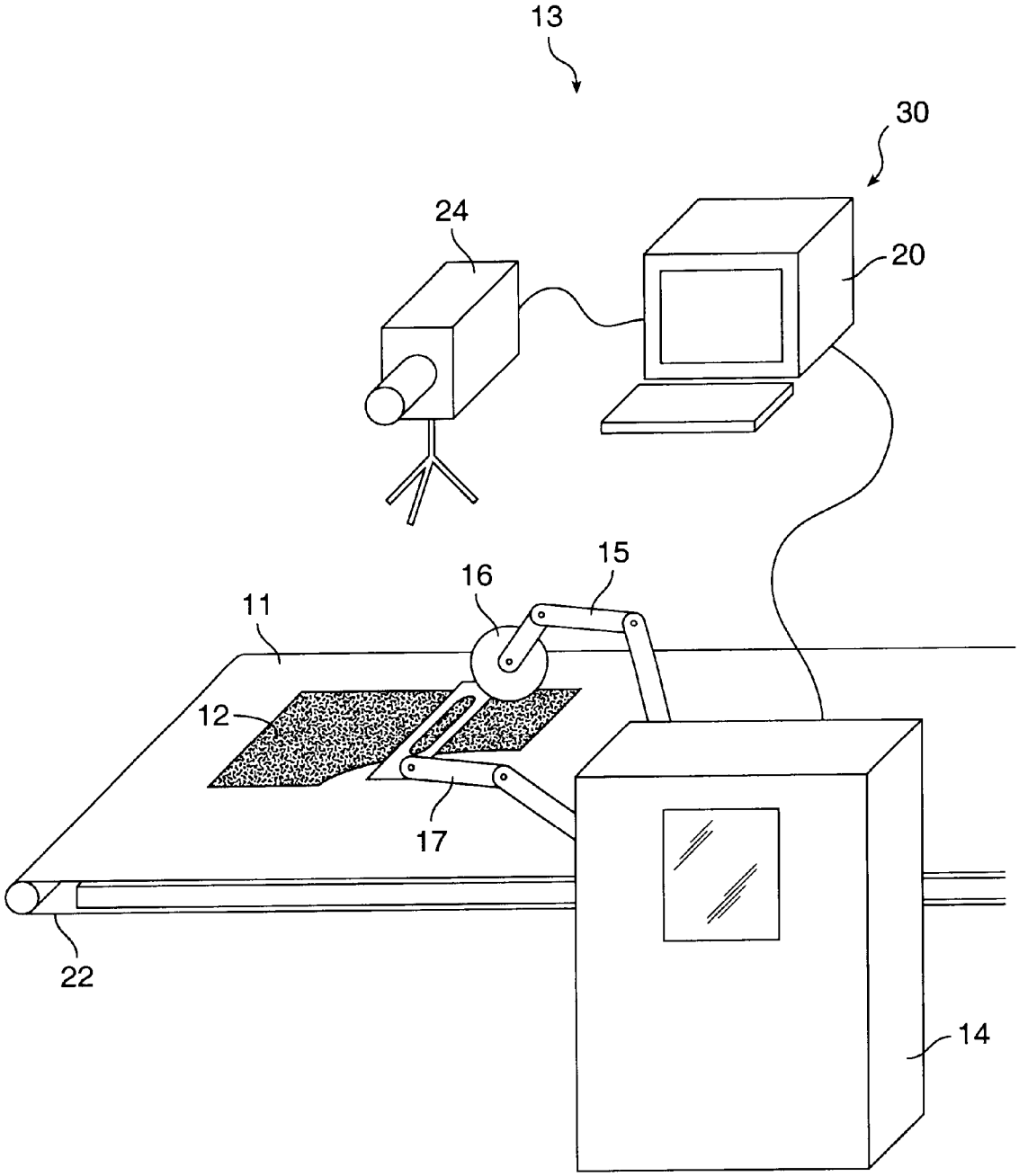
FIG. 2A is a perspective view of an apparatus of the present invention including a work station, a visual detection system, a controller, a robot, a hold down means, and an abrasion means.

The first step 1 begins by advancing an individual, pre-cut fabric workpiece 12 onto a work station 11 as shown in FIG. 2. The workpieces 12 can be manually placed onto the work station 11 by an operator, or preferably, individual workpieces 12 are automatically advanced to the work station 11 using conventional means such as a conveyor 22, or by other means such as, for example, a garment feeding device as disclosed in U.S. Pat. No. 5,039,078, incorporated herein by reference.

STEP 2: Determine if a Workpiece is on the Work Surface

The work station 11 can be equipped with sensors that indicate to a controller 20 whether a workpiece 12 is actually present on the work station 11 surface. The sensors could consists of photo-sensitive sensors which can be positioned on the work surface. A workpiece 12 on the work station 11 will block light to one or more of the photo-sensitive sensors, indicating to the controller 20 that a workpiece 12 is present. Alternatively, the sensors could be contact sensors that can detect the presence of the workpiece 12 by its contact with one or more of the sensors. If the sensors do not detect a workpiece 12, the controller 20 will repeat step 1 until the sensors detect a workpiece 12 at the work station 11.

STEP 3: Determine if the Workpiece Matches a Stored Shape and Size

The work station 11 is equipped with a visual detection system 13 for capturing an electronic image of workpiece 12 to be used for dentifying workpiece 12 and/or for determining the shape, size, and orientation of workpiece 12. The detection system 13 includes one or more video cameras 24 operably connected to a controller 20. See, e.g. U.S. Pat. No. 5,790,687 issued Aug. 4, 1998 for "Method and Apparatus for the Optical Determination of the Orientation of a Garment Workpiece" and U.S. Pat. No. 5,530,652 issued on Jun. 25, 1996 for "Automatic Inspection and Measurement System", which are incorporated herein by reference.

Determining the shape and size of workpiece 12 can be accomplished by comparing the captured electronic image of the workpiece 12 to an image or images stored in memory 30 accessible by controller 20. One method for comparing the images could involve entering the expected shape and size of workpiece 12 and comparing the electronic image to determine if the actual workpiece is an expected workpiece.

For example, the operator could enter the size and shape information when the workpieces 12 are placed onto a staging area (not shown) just before work station 11. Commonly workpieces 12 are cut out of a multi-layered stack of fabric and are transported as a bundle to the next station. A stack of like workpieces typically contains identifying markings such as a bar code or number code. When the stack of like pieces are positioned to be fed onto the work station 11, the operator could scan the bar code or enter a number code that would indentify to the controller 20 the shape and size of workpieces to be finished.

The controller 20 can then access a stored data file corresponding to the expected shape and size of workpieces. The data file can contain a model electronic image for comparison. If the stored image and the captured image substantially match, controller 20 will then select the proper finishing pattern and finishing pattern size as explained in Step 5 below. If the images do not substantially match, controller 20 will reject the workpiece as explained in Step 4 below.

Alternatively, the kind of workpiece can be determined by comparing the captured image to all images in memory until a match is found. Like the method listed above, the optical system 13 could scan workpiece 12 and capture an electronic image. This image could then be compared to a set of images stored in a database. By matching the scanned image of workpiece 12 to a known image in its database, controller 12 can identify workpiece 12. Once workpiece 12 has been identified, controller 12 will proceed to Step 5 as detailed below. If controller 20 fails to identify workpiece 12 because it could not find a match from among all the stored images in the database, then controller 20 will move to Step 4 which is explained below. As one skilled in the art will understand, the images stored in memory can include images which are the same general shape, but which have been scaled to size along one or more different edges to account for size variation between pieces. Thus, for example, the system could be used to check for out-of-tolerance pieces as well as incorrect pieces, such as scrap.

Figure 2B:
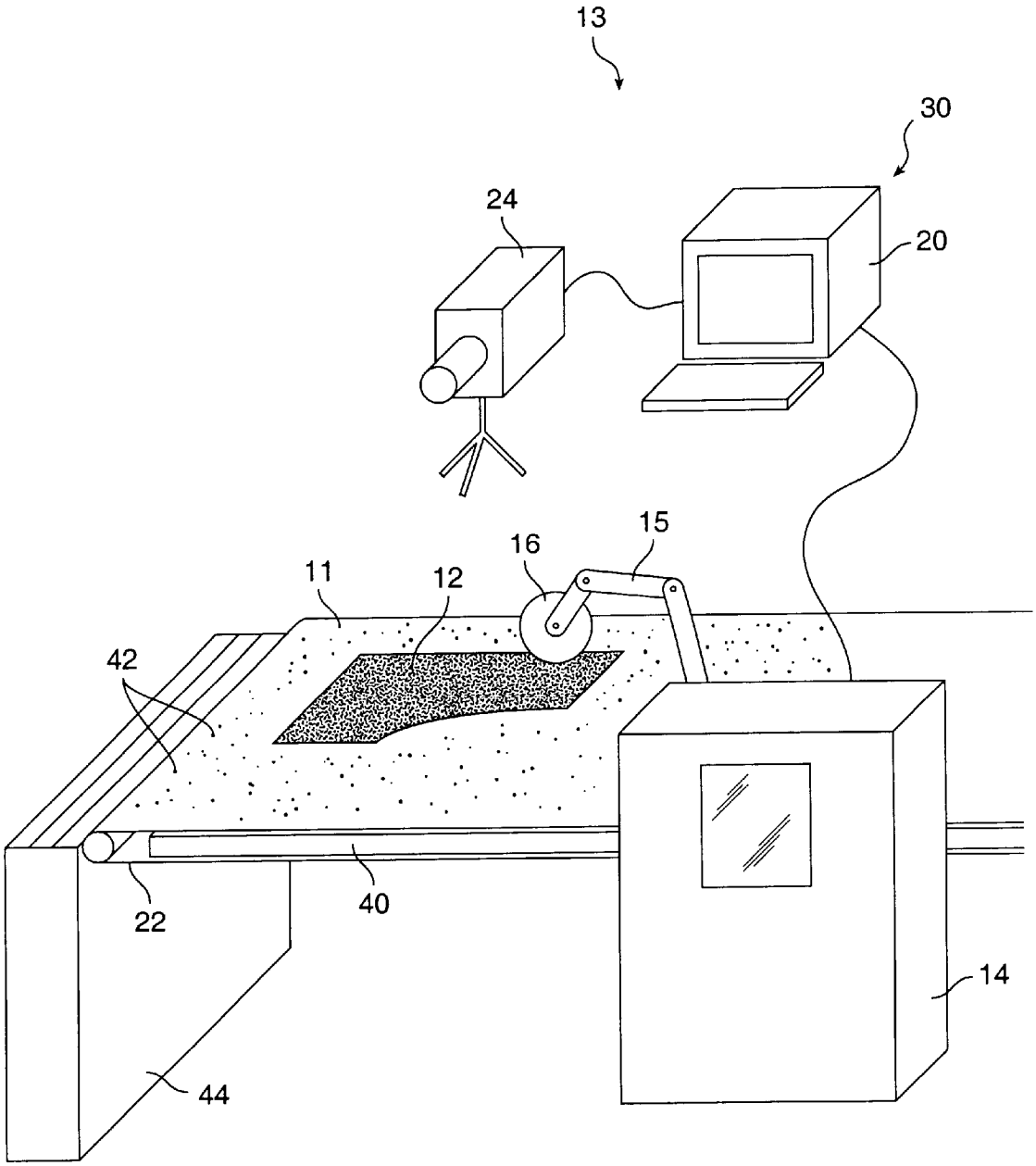
FIG. 2B is a perspective view of a modified apparatus of the present invention including a workpiece inverter and vacuum conveyor.

As part of the system, optical detector 13 can also be provided with a conventional sensor for determining which side of the fabric workpiece is facing the camera 24. Denim fabric, for example, typically has a dark or dyed side which forms the outer surface of a garment, and a lighter side, which forms the inner surface of a garment. Since the dark, outer surface is typically the surface which is faded during finishing, it is important that the dark, outer surface face the tool 16 for fading. If the sensor determines the light side is facing the tool 16, an arm fitted with a conventional engagement means such as a vacuum head or wire brush, can be used to invert the workpiece 12 at work station 11. More preferably, however, the workpiece 12 is oriented with the light side resting on the conveyor 22 and the dark side up at a location upstream of work station 11 using an inverter 44 as shown in FIG. 2B. For devices which can be used for this purpose see, for example, U.S. Pat. No. 4,968,021 issued Nov. 6, 1990 and 5,106,075 issued Apr. 21, 1992, and U.S. patent application Ser. No. 08/821,784 filed on Mar. 21, 1997, which are incorporated herein by reference.

STEP 4: ERROR—Release Workpiece & Move It to Non-Conforming Parts Bin

If a workpiece 12 fails to match one of the stored images, controller 20 will signal an error message. Since the workpiece 12 does not match any of the proper patterns, it is a non-conforming part. A non-conforming workpiece 12 could result from a number of reasons. For example, the cutting pattern for the workpiece could be out of specification, or a stack of workpiece that do not receive localized finishing could have been inadvertently loaded onto the work station 11. More likely, it is possible that a piece or pieces of scrap fabric could be intermingled in the stack of workpieces. If a scrap piece is loaded onto work station 11, the present method can detect it and move it out of the process flow and to a non-conforming parts bin. The contents of the bin can be periodically checked and properly disposed of by an operator.

After the non-conforming part has been removed from the process flow, controller 20 moves to Step 9 (below) which involves checking for more workpieces 12. If more workpieces 12 are at the staging area, the process starts again at Step 1 by advancing the next workpiece 12 to work surface 11.

Note that Steps 3 and 4 play at least two key roles. Not only do they determine the workpiece's shape and size which is important for Step 5 (below), but they also act as a quality filter. Any workpieces that are not proper quality are removed from the system before substantial labor and materials have been wasted on them.

STEP 5: Selection of a Finishing Pattern Type and Pattern Size

Step 5 comprises two major processes. The first process involves selecting the proper finishing pattern for the workpiece. The second process involves selecting the proper finishing pattern size.

STEP 5A: Selection of a Finishing Pattern Type

Figure 3A:
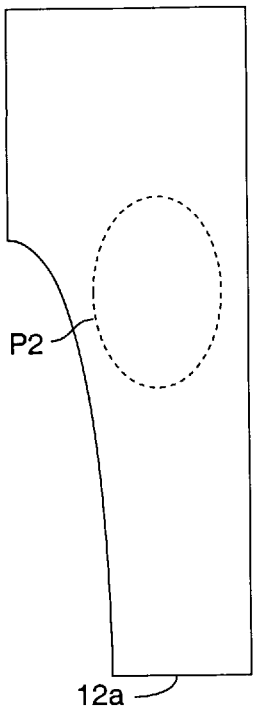
FIG. 3A is a top view of a workpiece with its designated fading pattern.
Figure 3B:
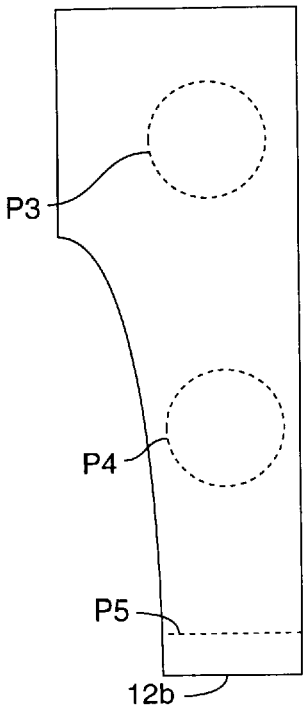
FIG. 3B is a top view of a workpiece with its designated fading patterns.

Once the shape and size of workpiece 12 has been determined, the finishing pattern must be determined. This selection can occur in several ways. For example, an automatic selection means could comprise sequencing each workpiece 12 to an finishing pattern or set of patterns. For example, as shown in FIG. 3A, a workpiece 12*a* could be sequenced to receive a localized fading pattern P2, whereas the next consecutive workpiece 12*b*, as shown in FIG. 3B, could be programmed to receive fading patterns P3, P4, and P5. Ideally, a multitude of patterns, P*n*, could be stored and utilized by controller 20.

Figure 4A:
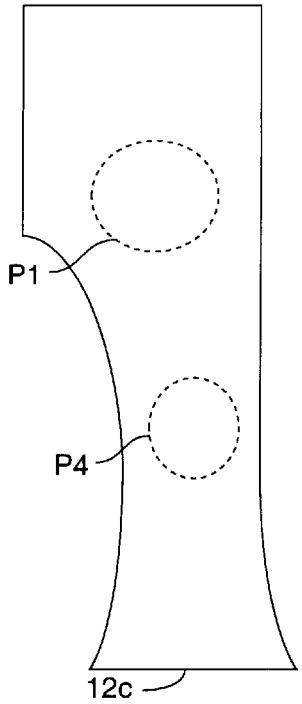
FIG. 4A is a top view of a workpiece with its designated fading patterns.
Figure 4B:
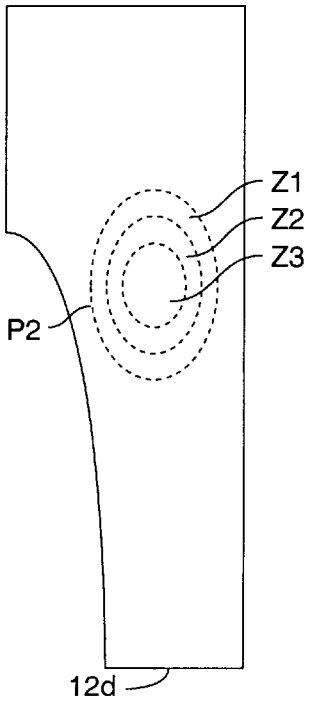
FIG. 4B is a top view of a workpiece with its designated fading pattern.

A more preferred automatic selection means could comprise linking each workpiece shape to a localized finishing pattern or patterns. To determine the pattern to be duplicated on each individual workpiece 12, controller 20 can be programmed with data corresponding to the different shapes and different sizes it will encounter. Once controller 20 matches the workpiece 12 at work station 11 to an image in its database, it will also access the pattern corresponding to that style of workpiece 12. For example, FIG. 4A and 4B depict two different shaped fabric workpieces, 12*c* and 12*d*. By comparing the shape of the workpiece 12*c* to a set of standard shapes, the controller 20 can identify that workpiece 12*c* shown in FIG. 4A receives fading patterns P1 and P4. Similarly, a different workpiece 12*d*, as shown in FIG. 4B, can be compared and linked to its assigned fading pattern, P2. Pattern P2 may include zones of different degrees of abrasion or fading intended to duplicate natural fading in the sewn garment. For example, z1 may be a zone of least abrasion, z2 may be a xone of moderate abrasion, and z3 a zone of relatively high abrasion, with the boundary between the zones feathered to provide a visually smooth and indistinct transition from one zone to another. Because each style of workpiece 12 is linked to a finishing pattern, this method is also applicable if the operator enters the shape and size of the workpieces. Once the operator enters this information, controller 20 knows what pattern to apply.

STEP 5B: Selection of a Finishing Pattern Size

Once the fading pattern has been determined, the controller must determine what size of fading pattern to apply to the workpiece 12. The fading pattern size could be determined by correlating each workpiece to a standard size or by scaling each area to the individual workpiece 12. In the first method, the controller could take the size of the scanned image and correlated it to a standard size listed in its database. Just as each standard shape was assigned a fading pattern, each standard size can be assigned a standard, pre-determined fading pattern size.

Figure 5:
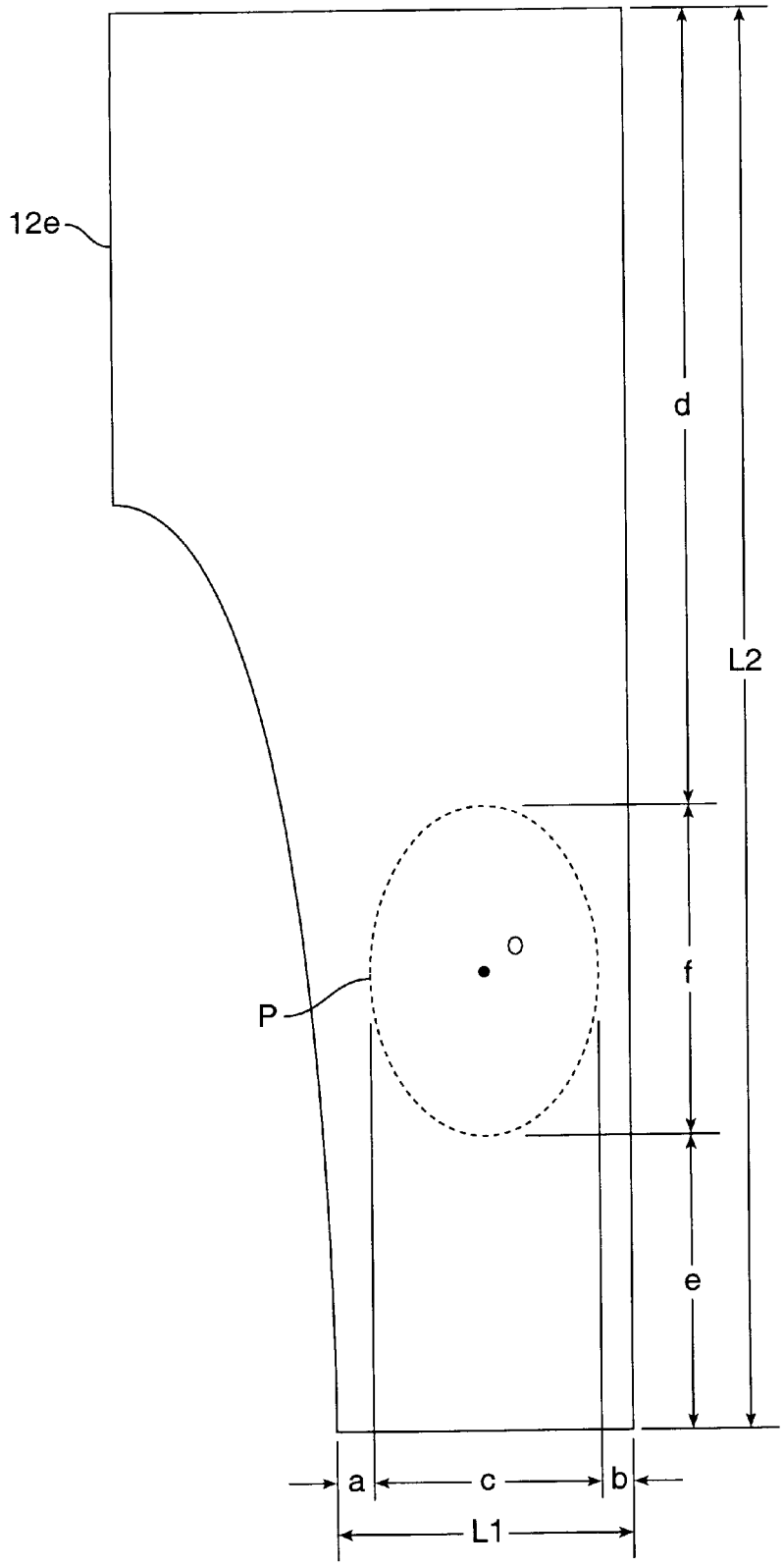
FIG. 5 is a top view of a workpiece with a scalable fading pattern.

Alternatively, controller 20 could use one or more dimensions of the workpiece 12 to scale a standard finishing pattern to fit the specific workpiece on the work surface 11. This method is advantageous because it eliminates the need to predetermine and store specific fading or finishing patters for each size and shape workpiece to be encountered by the equipment. Consider workpiece 12*e* as depicted in FIG. 5. If each key dimension, a–f, is defined as a fixed proportion of an overall dimension, L1 or L2, the faded area will always be positioned and sized in proper proportion to the workpiece. By setting a=k1*L1, b=k2*L1, c=k3*L1, d=k4*L2, e=k5*L2, and f=k6*L2 and given L1 and L2 from the scanned image, the proper size and position of the faded area can always be determined. Alternatively, the faded area could also be defined by measuring fixed distances inward from the edge of the workpiece. For example, the abraded area could be defined by setting a=d1, b=d2, d=d3, and e=d4. In this way, as the workpiece increases, the faded area also increases.

Each of the above stated methods illustrate that the present invention can automatically adjust the size of the abraded area to better match the size of the workpiece. One skilled in the art will recognize related ways to achieve similar results.

STEP 6: Securing the Workpiece to the Work Surface

For abrasion techniques that require a robot 14 to contact workpiece 12 directly, a hold-down means 17 can be provided to secure workpiece 12 in position on the work surface of station 11. Because no force is applied directly to workpiece 12 while finishing it with amplified light or with chemicals, securing it may not be required. However, securing workpiece 12 is particularly important while mechanically fading the fabric using direct force which would otherwise cause workpiece 12 to move in the direction of the applied force.

Any conventional hold-down apparatus can be used. Such an apparatus could comprise, for example, a vacuum plenum 40 under work station 11 in communication with perforations in the work surface of station 11 for holding workpiece 12 by vacuum pressure to the underlying surface, rod-like fingers which apply a perpendicular force on the workpiece 12, or a template frame 17 which applies a force to hold workpiece 12 stationary.

Hold-down assembly must be applied in such a way as to not cover the portion of workpiece 12 that is intended to be faded. The vacuum plenum 40 works well in this regard since it applies suction below workpiece 12 and leaves the entire top surface of workpiece 12 exposed. Hold-down assemblies 17 other than the vacuum plenum 40 could be connected to and operated by robot 14. Once robot 14 receives information from controller 20 regarding the area to fade, robot 14 can activate holddown apparatus 17 to secure workpiece 12 is such a way that it does not interfere with the fading process.

If a vacuum system is used, a vacuum assembly can be added as part of work station 11. The work surface of work station 11, upon which workpiece 12 is placed, could contain of a plurality of small openings 42. Prior to finishing workpiece 12, a vacuum pump connected to work station 11 is activated. The suction created by the vacuum pump generates vacuum pressure at the small openings 42 in the surface of work station 11. The vacuum pressure at the small openings 42 secures workpiece 12 against the work surface of work station 11. An additional benefit to the present embodiment is that chemicals, water, and other solutions used to finish workpiece 12 can be captured in a reservoir by the vacuum pump. The captured liquids can be recycled or otherwise disposed.

If hold down rods or fingers are used, they preferably include a non-penetrating pin tip. However, the tips could also be a penetrating needle-type tip. The hold-down fingers can be constructed from pneumatic or hydraulic cylinders having pistons which move the fingers along a vertical axis. Alternatively, hold-down fingers could be spring loaded or driven by a stepper motor or similar device. While workpiece 12 is placed onto work station 11, the hold-down fingers can be positioned in an upward position, suspended above workpiece 12. To secure workpiece 12, the hold-down fingers can be moved vertically downward until the tips of the hold down fingers contact and capture workpiece 12. The force exerted against workpiece 12 secures it during the finishing process.

If a template frame is used, robot 14 could be equipped with a template made of a substantially planar sheet of material through which there is an opening. The template can be positioned on top of workpiece 12 with the opening exposing the area to be faded. The force exerted by the surface material of the template onto workpiece 12 secures it into position on the work surface.

STEP 7: Applying the Finishing Pattern to the Workpiece

With the fading pattern determined and workpiece 12 secured to work station 11, controller 20 can control a mechanical device such as a robot 14 to apply the finish (e.g., fade work piece 12) in the area identified by the pattern. Since the fading must be performed in one or more specific regions on the workpiece 12, it is very important for reproduceability over a plurality of workpieces that controller 20 knows where workpiece 12 is and how it is oriented. Because detection system 13 can capture an image of workpiece 12 and determine its location and orientation, workpieces 12 need not be placed on work station 11 in a predetermined orientation, although this can be accomplished if desired. Rather, in the preferred embodiment, the controller, based upon the image information from the camera, would determine the size, location and orientation of the workpiece on the work surface, determine the correct customized abrasion pattern for the workpiece, and control the mechanical device to apply that abrasion pattern to the workpiece.

Robot 14 controlled by controller 20 can provide the desired finish to selected regions of each workpiece by using a finishing means 16 such as, for example, a laser, powered wire brush, abrasive wheel, or spray system for applying a dry or liquid finishing agent such as, for example, sand or other abrasive particles, bleach, enzyme, ozone, etc. Almost anything that a human operator could hold in his or her hand for finishing, such as a spray nozzle, sandblast nozzle, paint brush, air brush, or abrasive device can be mounted for operation on a computer-controlled robot arm 15.

Use of a robot 14 can be particularly advantageous in reproducing some effects which are almost impossible to duplicate by human workers armed with ordinary spray and sandblast tools. For example, a wallet or can of chewing tobacco or snuff, constantly carried in one pocket of a pair of jeans, will cause a visible faded outline around it creating a distinctive effect of actual wear. To consistently reproduce such an effect on thousands of workpieces which are to be sewn into pairs of new jeans would require a level of consistent artistry difficult, if not impossible, for human operators to achieve. However, a robot 14 can be programmed to direct a laser beam or a fine spray of a bleaching agent to create the same faded outline design of a tobacco can or wallet on every workpiece 12 that it treats.

Aside from the advantages of repeatability and reliability, robots have other advantages for finishing of garment workpieces. A robot 14 is substantially unaffected by laser light, bleaches, sand, dyes and other agents which can adversely affect human operators. A robot 14 can perform its functions in a closed booth, keeping noise, dust, and any pollutants which may be created during finishing out of areas where human operators perform their work.

The degree to which a workpiece 12 is abraded can be determined in several ways. For example, the time period in which the robot abrades the fabric can be a set duration to achieve a particular effect. Other methods could include using sensors. Robot 14 could fade the fabric until a measured parameter reaches a predetermined level. Such a system could be incorporated into optical detection system 13 or could be incorporated into robot 14 wherein the lightness or darkness of the fabric is detected. Once the fabric is faded to achieve the predetermined effect, robot 14 will discontinue finishing.

STEP 8: Release the Workpiece and Transport It to the Next Station

When the finishing process is complete, controller 20 removes the means used to secure workpiece 12 to work station 11. The faded workpiece 12 is advanced to the next station or can be restacked with like workpiece and transported in bulk to the next work station or to a storage area.

STEP 9: Determine If More Workpieces are Waiting to be Finished

After a workpiece has been finished and removed from the work surface 11, controller 20 can determine if more workpieces 12 are waiting to be advanced on work station 11. To determine if workpieces 12 are waiting to be advanced, the staging area (not shown) could be equipped with conventional sensors to detect the presence of workpieces 12. If workpieces 12 are present at the staging area, controller 20 can repeat the present method by starting at Step 1 and advancing a workpiece 12 onto work surface 11. If no workpieces 12 are available, the system could remain idle until a workpiece 12 is detected.

The present invention has been described in terms of the preferred embodiment. One skilled in the art will recognize that it would be possible to construct the elements of the present invention from a variety of materials and to modify the arrangement in a variety of ways. For example, it would be possible to create a dedicated finishing machine for finishing a workpiece of one predetermined shape and size only. This would eliminate the need to capture an image of the workpiece, since the same finishing pattern could be applied every time to each workpiece. Likewise, it would be possible to use a controller to select a specific pattern to be applied to a workpiece, and then, rather than having the controller automatically control a mechanical device to achieve the desired image, the controller could project the pattern or image onto the workpiece, or identify a template which could be manually placed over the workpiece, to enable an operator using the mechanical device to reproduce the pattern manually. The present invention may also be useful when applied to workpieces of materials other than fabric, such as, for example, plastics, vinyl, and leather. One skilled in the art will also recognize that the present invention can be also be used to perform several finishing and pattern marking techniques in addition to fading, such as, for example, applying a dye or paint to a fabric workpiece.

What is claimed is:

1. An automated apparatus for automatically finishing a pre-determined portion of a pre-cut garment workpiece prior to its assembly with other garment workpieces to produce a complete garment, said workpiece having a first side, a second side, and predetermined dimensions, the apparatus comprising:

(a) a work station containing a surface upon which said workpiece is placed for finishing;

(b) a controller for receiving data representative of the size and shape of the workpiece, (c) a storage means operatively linked to said controller, said storage means containing data corresponding to predetermined workpiece shapes and sizes, along with data corresponding to a finishing pattern to be applied to a portion of each predetermined workpiece having a particular shape and size;

(d) a mechanical device positioned adjacent to said work station, for reproducing said pattern on said portion of said workpiece; and, (e) a means for sensing if more workpieces are available to be advanced onto the station.

2. The apparatus of claim 1 additionally including a means for sensing which of the first side and the second side of said workpiece is resting upon said surface.

3. The apparatus of claim 2 additionally including a means for inverting the workpiece.

4. The apparatus of claim 1 wherein said surface is substantially planar and substantially horizontal.

5. The apparatus of claim 1 additionally including an optical detection system mounted adjacent to said surface and linked for communication with said controller for capturing and transmitting to said controller an image of said workpiece.

6. The apparatus of claim 1 additionally including a means for securing said workpiece against movement.

7. The apparatus of claim 6 wherein said surface is perforated, and said means for securing said workpiece includes a vacuum plenum in communication with said surface.

8. The apparatus of claim 5 wherein said optical detection system includes at least one video camera.

9. The apparatus of claim 1 wherein said mechanical device is a tool used to fade said fabric workpiece.

10. The apparatus of claim 9 wherein said tool is selected from the group consisting of lasers, abraders, and sprayers.

11. The apparatus of claim 9 wherein said tool is controlled by an industrial robot operatively linked to said controller.

12. The apparatus of claim 1 wherein said mechanical device is controlled by said controller by projecting an image of said pattern onto said fabric workpiece whereby an operator can manually apply said mechanical device to said projected image to reproduce said pattern.

13. The apparatus of claim 1 wherein said finishing pattern is predetermined for each shape workpiece.

14. The apparatus of claim 13 wherein said controller scales said finishing pattern based on one or more dimensions of said workpiece.

15. A method for applying a localized finish to a predetermined portion of a pre-cut fabric workpiece prior to its assembly with other fabric workpieces to produce a complete garment using an apparatus including a work station containing a surface upon which said workpiece is placed for finishing; a controller for receiving data representative of the location, orientation, and dimensions of the workpiece, a storage means operatively linked to said controller, said storage means containing data corresponding to workpiece shapes and sizes, along with data corresponding to a finishing pattern to be applied to a portion of each workpiece, and a mechanical device positioned adjacent to said work station, for reproducing said pattern on said portion of said workpiece, said fabric workpiece having a first side, a second side, and predetermined dimensions, the method comprising:

(a) advancing the fabric workpiece to the work station;

(b) using the controller to determine the finishing pattern to be applied to a predetermined portion of the workpiece by capturing an electronic image of the workpiece, transmitting the electronic image to the controller whereby the controller can compare said electronic image to at least one stored image to identify the workpiece, and a corresponding finishing pattern;

(c) identifying and removing from the work station any workpiece that does not conform to at least one of the stored images; and, (d) reproducing the finishing pattern on a predetermined portion of each identified workpiece using the mechanical device.

16. The method of claim 15 wherein the step of reproducing the finishing pattern on a predetermined portion of the workpiece is carried out by an industrial robot operatively linked to the controller.

17. The method of claim 15 wherein the step of determining a finishing pattern to be applied to the workpiece is performed by scaling a predetermined finishing pattern using one or more dimensions of the workpiece.

18. The method of claim 15 additionally including the step of securing the workpiece to the work station before reproducing the finishing pattern so that the workpiece does not move during finishing.

19. A method for applying a localized finish to a predetermined portion of a pre-cut fabric workpiece prior to its assembly with other fabric workpieces to produce a complete garment using an apparatus including a work station containing a surface upon which said workpiece is placed for finishing; a controller for receiving data representative of the location, orientation, and dimensions of the workpiece, a storage means operatively linked to said controller, said storage means containing data corresponding to workpiece shapes and sizes, along with data corresponding to a finishing pattern to be applied to a portion of each workpiece, and a mechanical device positioned adjacent to said work station, for reproducing said pattern on said portion of said workpiece, said fabric workpiece having a first side, a second side, and predetermined dimensions, the method comprising:

(a) advancing the fabric workpiece to the work station;

(b) using the controller to determine the finishing pattern to be applied to a predetermined portion of the workpiece by capturing an electronic image of the workpiece, transmitting the electronic image to the controller whereby the controller can compare said electronic image to at least one stored image to identify the workpiece and a corresponding finishing pattern;

(c) removing from the work station any workpiece that does not conform to at least one of the stored images; and (d) using the mechanical device to reproduce the finishing pattern on a predetermined portion of each workpiece which does conform to at least one of the stored images.

20. An automated apparatus for automatically finishing a pre-determined portion of a pre-cut fabric garment workpiece prior to its assembly with other fabric garment workpieces to produce a complete garment, said fabric workpiece having a first side, a second side, and predetermined dimensions, the apparatus comprising:

(a) a work station containing a surface upon which said fabric workpiece is placed for finishing;

(b) a controller for receiving data representative of the size and shape of the fabric workpiece, (c) a storage means operatively linked to said controller, said storage means containing data corresponding to predetermined fabric workpiece shapes and sizes, along with data corresponding to a finishing pattern to be applied to a portion of each predetermined fabric workpiece having a particular shape and size; and, (d) a means for reproducing said pattern on said portion of said fabric workpiece.

* * * * *